US006764283B2

(12) United States Patent
Bodzak

(10) Patent No.: US 6,764,283 B2
(45) Date of Patent: Jul. 20, 2004

(54) INTERNAL GEAR WHEEL PUMP

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/110,902

(22) PCT Filed: Aug. 3, 2001

(86) PCT No.: PCT/DE01/02965

§ 371 (c)(1),
(2), (4) Date: Jul. 22, 2002

(87) PCT Pub. No.: WO02/16772

PCT Pub. Date: Feb. 28, 2002

(65) Prior Publication Data

US 2003/0026711 A1 Feb. 6, 2003

(51) Int. Cl.[7] ..... F04B 49/00
(52) U.S. Cl. ..... 417/298; 418/19; 418/170
(58) Field of Search ..... 417/298, 219, 417/310, 440; 418/19, 31, 166, 170, 171, 168, 169, 102, 182, 24, 27, 28

(56) References Cited

U.S. PATENT DOCUMENTS 3,026,809 A * 3/1962 Anderson et al. ..... 103/120
3,515,496 A * 6/1970 Eddy ..... 417/440
4,161,372 A * 7/1979 Bosch ..... 418/126
4,492,539 A * 1/1985 Specht ..... 418/19
5,299,923 A * 4/1994 Arbogast et al. ..... 418/169
6,126,420 A * 10/2000 Eisenmann ..... 418/19

FOREIGN PATENT DOCUMENTS

DE 38 27 573 A1 2/1990

* cited by examiner

*Primary Examiner*—Justine R. Yu
*Assistant Examiner*—Hau L Liu
(74) *Attorney, Agent, or Firm*—Michael J. Striker

(57) ABSTRACT

An internal gear pump for pumping fuel from a suction conduit (18) into a pressure conduit (19) has a pump housing (1) in which an internal ring gear (5) and an externally toothed pinion (3), the latter driven by a drive shaft (2), are supported. The pinion (3) is disposed eccentrically to the ring gear (5) and cooperates with the ring gear (5) to generate a pumping action. The pinion (3) and the ring gear (5) rest with their one face end on the pump housing (1) and with their other face end on a sealing plate (13). To lengthen the service life of the internal gear pump, the suction conduit (18) is disposed in the sealing plate (13). The sealing plate (13) is movable relative to the pump housing (1) such that the spacing between the suction conduit (18) and the pressure conduit (19) can be varied.

7 Claims, 2 Drawing Sheets

INTERNAL GEAR WHEEL PUMP

BACKGROUND OF THE INVENTION

The invention relates to an internal gear pump for pumping fuel from a suction conduit into a pressure conduit, having a pump housing in which an internal ring gear and an externally toothed pinion, the latter driven by a drive shaft, are supported, the pinion being disposed eccentrically to the ring gear and cooperating with the ring gear to generate a pumping action, and the pinion and the ring gear rest with their one face end on the pump housing and with their other face end on a sealing plate.

An internal gear pump of this kind is also called a ring gear pump or gear-rotor pump. The ring gear and the pinion represent the pump elements and are also called the outer rotor and the inner rotor, respectively. In German Patent Disclosure DE 38 27 573 A1, an internal gear pump is described whose ring gear is driven via an electric motor. The pumping chambers of the internal gear pump that are located between the sets of teeth of the two pump elements are covered in the axial direction by a pressure plate. A helical spring, embodied as a compression spring, which is prestressed against the pressure plate assures that the axial play equals zero when the internal combustion engine is started.

When an internal combustion engine is operated with an internal gear pump of this kind, it has been found that upon engine starting, the maximum pumping capacity of the internal gear pump is required. Once the engine has reached its full rpm, a lesser pumping capacity suffices to assure an adequate fuel supply to the engine.

The object of the invention is to furnish an internal gear pump of the type defined at the outset, which has zero axial play at starting rpm and whose pumping capacity decreases once the starting rpm has been exceeded. It should be possible to produce the internal gear pump of the invention economically, and the pump should have a long service life.

In an internal gear pump for pumping fuel from a suction conduit into a pressure conduit, having a pump housing in which an internal ring gear and an externally toothed pinion, the latter driven by a drive shaft, are supported, the pinion being disposed eccentrically to the ring gear and cooperating with the ring gear to generate a pumping action, and the pinion and the ring gear rest with their one face end on the pump housing and with their other face end on a sealing plate, this object is attained in that the suction conduit is disposed in the sealing plate, and that the sealing plate is movable relative to the pump housing in such a way that the spacing between the suction conduit and the pressure conduit can be varied.

SUMMARY OF THE INVENTION

If the spacing between the suction conduit and the pressure conduit is decreased, the consequence is that the pumping capacity of the internal gear pump decreases. This offers the advantage that an intake throttle, required in conventional internal gear pumps, can be dispensed with.

A particular feature of the invention is characterized in that the suction conduit is formed by an elongated recess in the circumferential direction of the sealing plate, and that the sealing plate is rotatable relative to the pump housing between two points.

A further particular feature of the invention is characterized in that the sealing plate is prestressed in the axial direction with the aid of a spring, which is coupled to the pump housing and to the sealing plate. By the spring prestressing in the axial direction, it is attained that a motion of the sealing plate in the axial direction does not occur until a certain pressure in the pump chamber has been exceeded.

A further particular feature of the invention is characterized in that the spring is prestressed in the circumferential direction counter to the driving direction of the internal gear pump. Because of the spring prestressing in the circumferential direction, it is attained that the sealing plate does not rotate until a certain rpm of the pinion has been exceeded.

A further particular feature of the invention is characterized in that the spring includes two curved legs, which on one end are joined together and coupled to the sealing plate, and on the other end are coupled to the pump housing. By the design according to the invention of the spring, a prestressing of the spring both in the axial direction and in the circumferential direction is made possible by simple means.

A further particular feature of the invention is characterized in that on the side of the sealing plate remote from the ring gear and the pinion, a pin is guided axially displaceably at a certain spacing, which pin cooperates with a further spring in order to counteract a motion of the sealing plate in the axial direction. The spacing between the sealing plate and the pin is selected such that the sealing plate comes to rest on one face end of the pin in full-load operation. If the pressure in the pump chamber rises further, the sealing plate moves farther counter to the prestressing force of the further spring. The prestressing force of the further spring, its spring rate, and the displacement of the sealing plate in the axial direction up to a stop define the maximum operating pressure of the internal gear pump.

A further particular version of the invention is characterized in that the suction conduit communicates with a fuel inlet, whose longitudinal axis coincides with the longitudinal axis of the drive shaft. This design has proved to be especially advantageous in practice.

A further particular feature of the invention is characterized in that the fuel inlet discharges into a sleeve, in which the further spring is received, and in which radial bores are mounted for the passage therethrough of fuel. The sleeve forms a stop that defines the axial motion of the sealing plate.

A further particular feature of the invention is characterized in that a bypass valve is accommodated in the pump housing and communicates with the suction conduit via a first axial bore and with the pressure conduit via a second axial bore. Within the context of the present invention, "axial" means in the direction of the longitudinal axis of the drive shaft of the internal gear pump. The bypass valve makes it possible, for instance with the aid of an additional hand-actuated pump, to pump the fuel in a way that bypasses the internal gear pump when the internal gear pump is not being driven.

Further advantages, characteristics and details of the invention will become apparent from the ensuing description, in which one exemplary embodiment of the invention is described in detail in conjunction with the drawing. The characteristics recited in the claims and mentioned in the description can each be essential to the invention individually or in arbitrary combination.

DETAILED DESCRIPTION OF THE PREFERRED EMBODIMENTS

Figure 1:
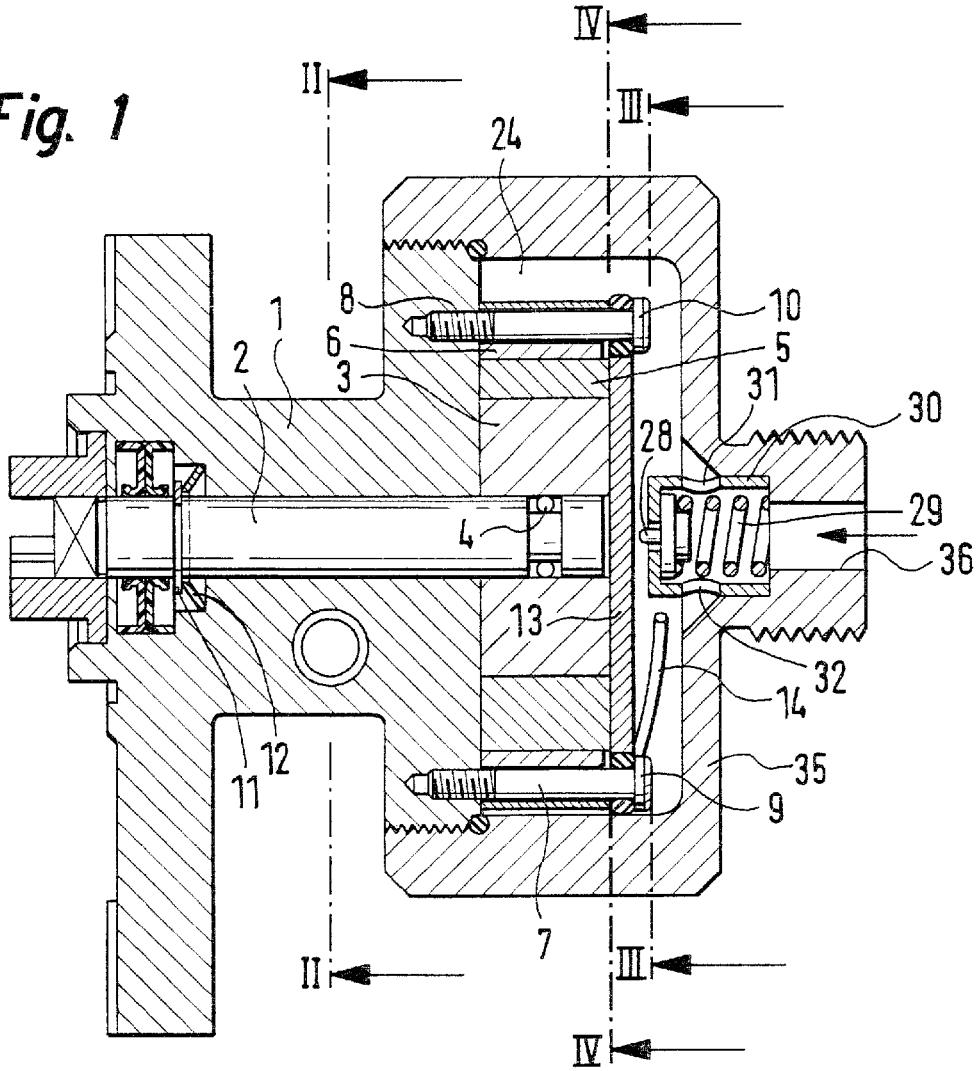
FIG. 1, one embodiment of an internal gear pump of the invention in longitudinal section.
Figure 2:
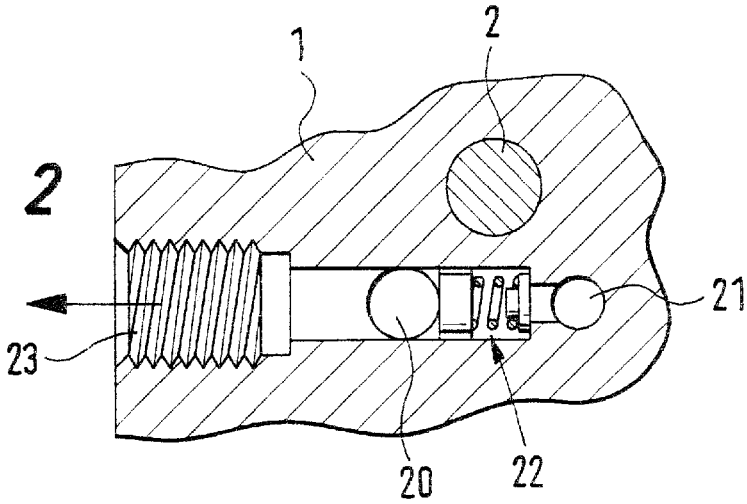
FIG. 2, the elevation view of a section taken along the line II—II in FIG. 1.

The internal gear pump shown in FIGS. 1–4 includes a pump housing 1. A drive shaft 2 is rotatably supported in the pump housing 1. With the drive shaft 2, an internal gear or pinion 3 is driven, which is mounted on the end of the drive shaft 2 with the aid of a tolerance ring 4. Internal gear 3 is in engagement with an external gear 5, which is also known as a ring gear. The external gear 5 is surrounded by a bearing ring 6, which is secured to the pump housing 1 with the aid of screws 7 and 8. The heads of the screws 7 and 8 are marked 9 and 10.

Figure 3:
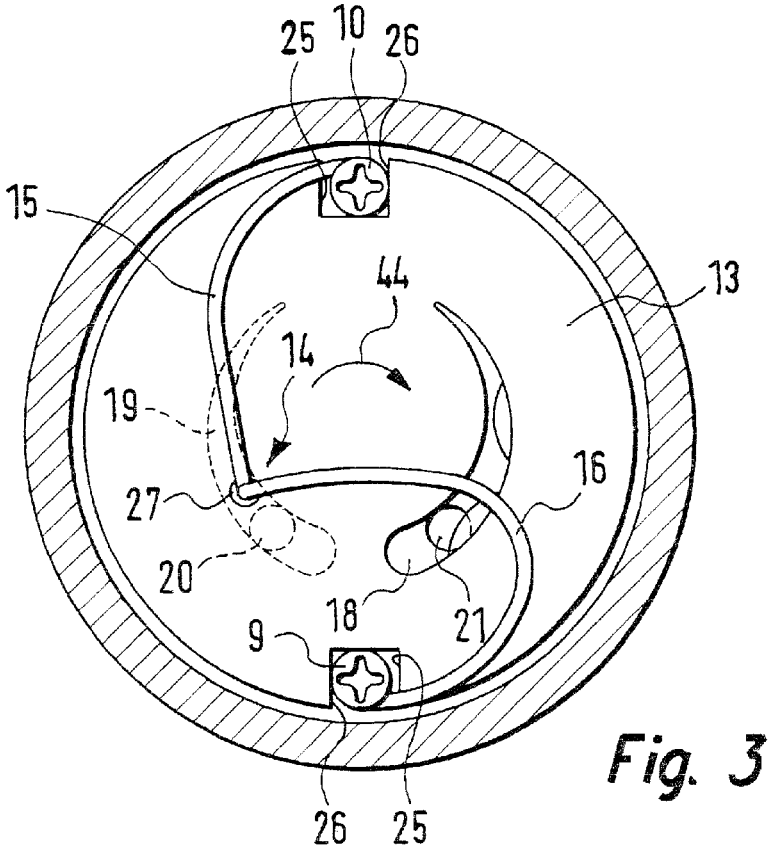
FIG. 3 the elevation view of a section taken along the line III—III in FIG. 1.

With the aid of a cup spring 12, which is braced against a Seeger ring 11 that is secured in a groove of the drive shaft 2, the drive shaft 2 is prestressed to the left, away from the internal gear 3. By the prestressing force of the cup spring 12, the internal gear 3 is kept in contact with the pump housing 1. A sealing plate 13 rests on the other face end of the gears 3 and 5. The sealing plate 13 is kept in contact with the gears 3 and 5 with the aid of a spring 14. As FIG. 3 shows, the spring 14 includes two curved legs 15 and 16. Two bent-over ends of the curved legs 15 and 16 are received in a blind bore 27 of the sealing plate 13. The two other ends of the legs 15 and 16 are secured to the screw heads 9 and 10 and thus to the pump housing 1.

Figure 4:
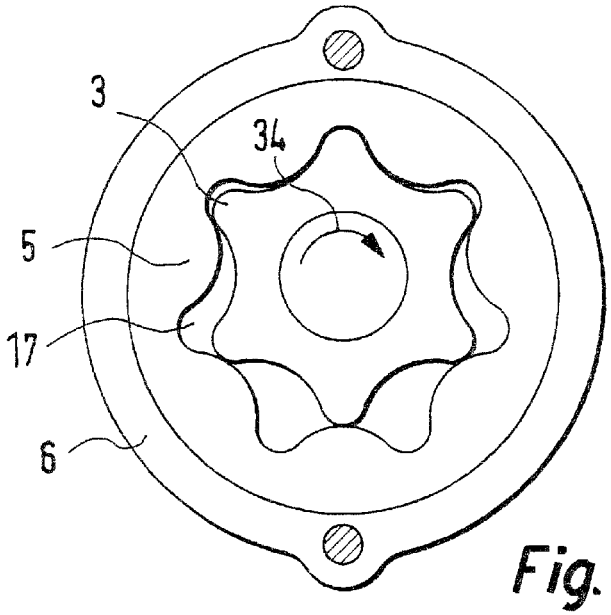
FIG. 4, the elevation view of a section taken along the line IV—IV in FIG. 1.

In FIG. 4, the direction of rotation of the drive shaft 2 is represented by an arrow 34. When the internal gear 3 is driven in the direction of the arrow 34, the fuel located in the pressure chamber 17 is compressed. Simultaneously, as can be seen in FIG. 3, fuel is aspirated from a suction conduit 18, which is recessed out of the sealing plate 13. The aspirated fuel is compressed in the pressure chamber 17 and then reaches a pressure conduit 19, which, as indicated by dashed lines in FIG. 3, is recessed out of the pump housing 1.

The suction conduit 18 and the pressure conduit 19 communicate via connecting bores 21 and 20 with a bypass valve 22. When the pre-stressed check valve 22 is opened, the two connecting bores 20 and 21 are in communication with one another. When the bypass valve 22 is closed, the communication between the connecting bores 20 and 21 is closed, and the pressure conduit 19 communicates with a pressure connection 23 via the connecting bore 20.

The suction conduit recessed out of the sealing plate 13 communicates with a suction chamber 24, which is surrounded by a housing cap 35. The housing cap 35 is seated on the pump housing 1. A central fuel inlet bore 36 is recessed out of the housing cap 35.

Two rectangular recesses are provided, diametrically opposite one another, on the outer circumference of the sealing plate 13. The two opposite sides of the recesses, together with the screw heads 9 and 10, form stops 25 and 26 for a rotary motion of the sealing plate 13. In the position of the sealing plate 13 as shown in FIG. 3, the stop faces 26 are in contact with the screw heads 9 and 10. An arrow 44 indicates that the sealing plate 13 rotates, with increasing rpm of the drive shaft 2, until the stop faces 25 rest on the screw heads 9 and 10.

In FIG. 1, it can be seen that a pin 28 is disposed on the side of the sealing plate 13 remote from the drive shaft 2. Between the sealing plate 13 and one face end of the pin 28, a certain spacing is provided. The pin 28 is subjected to the prestressing force of a compression spring 29 that is received in a sleeve 30. The pin 28 is also guided displaceably in the axial direction in the sleeve 30. The sleeve 30 is secured in the interior of the housing cap 35, coaxially to the fuel inlet bore 36. Bores 31 and 32 are recessed out of the jacket face of the sleeve 30, in order to assure the passage of fuel from the fuel inlet 36 into the suction chamber 24.

The internal gear 3 of the pump is driven by the drive shaft 2 and the tolerance ring 4. The cup spring 12 also keeps the internal gear 3 in contact with the plane face of the pump housing 1 counter to an axial force inward from the drive coupling that might possibly occur. The pump housing 1 supports the drive shaft 2 and includes the pressure conduit 13, the connecting bore 20 to the pressure connection 23, and the bypass valve 22. The bore 21 connects the bypass valve 22 to the suction chamber 24 of the internal gear pump and makes it possible, for instance by means of a hand-actuated pump, to pump the fuel in a way that bypasses the pump elements if the internal gear pump is not being driven.

The pump housing 1 supports the external gear 5 with the aid of the bearing ring 6. In the starting state, the sealing plate 13 is placed without play against the gears 3 and 5 and is pressed slightly by the spring 14. The force of the spring 14 is designed, for starting the internal gear pump, in such a way that an adequate fuel pressure for filling the low-pressure system is assured.

The second function of the spring 14 is to keep the sealing plate 13 in a position rotated relative to the direction of rotation of the gear during starting. This position guarantees the maximum supply quantity at starting rpm. Accordingly, the sealing plate 13 is pressed by the spring 14 against the stop 26, embodied as the screw head 10, counter to the direction of rotation of the gear. The plate 13 has no contact with the bearing ring 6, which is achieved by means of a play of approximately 0.01 mm.

When the rpm rises and the flow through the suction conduit 18 reaches the idling quantity, the plate 13 rotates, until the opposite stop face 25 rests on the screw head 10. This brings about a limitation of the supply quantity as the rpm rises. Hence no intake throttling of the pump is necessary, which reduces the tendency to cavitation. In full-load operation, the sealing plate 13 presses against the pin 28. When the pressure in the pressure chamber 17 reaches a limit value, the plate 13 moves farther to the right and presses against the spring 29, via the pin 28.

What is claimed is:

1. An internal gear pump for pumping fuel from a suction conduit (18) into a pressure conduit (19), comprising:

a pump housing (1) wherein an internal ring gear (5) and an eternally toothed pinion (3) are supported in said pump housing, wherein the externally toothed pinion is driven by a drive shaft (2), the pinion (3) being disposed eccentrically to the ring gear (5) and cooperating with the ring gear (5) to generate a pumping action, wherein the pinion (3) and the ring gear (5) rest with a first face end on the pump housing (1) and with a second face end on a sealing plate (13), wherein the suction conduit (18) is disposed in the sealing plate (13), wherein the sealing plate (13) is movable relative to the pump housing (1) in such a way that a spacing between the suction conduit (18) and the pressure conduit (19) can be varied, wherein the suction conduit (18) is formed by an elongated recess in a circumferential direction of the sealing plate (13), wherein the sealing plate (13) is rotatably relative to the rump housing (1) between two points, wherein the sealing plate (13) is prestressed in the axial direction with the aid of a spring (14), wherein said spring is coupled to the pump housing (1) and to the sealing plate (13), and wherein the spring (14) is prestressed in a circumferential direction counter to the driving direction of the internal pear pump.

2. The internal gear pump of claim 1, wherein the spring (14) includes two curved legs (15, 16), wherein the two curved lens are joined together on one end and coupled to the sealing plate (13), and on the other end are coupled to the pump housing (1).

3. An internal gear pump for pumping fuel from a suction conduit (18) Into a pressure conduit (19), comprising:

a pump housing (1), wherein an internal ring gear (5) and an externally toothed pinion (3) are supported in said pump housing, wherein the externally toothed pinion is driven by a drive shaft (2), the pinion (3) being disposed eccentrically to the ring gear (5) and cooperating with the ring gear (5) to generate a pumping action, wherein the pinion (3) and the ring gear (5) rest with a first face end on the pump housing (1) and with a second face end on a sealing plate (13), wherein the suction conduit (18) is disposed in the sealing plate (13), wherein the sealing plate (13) is movable relative to the pump housing (1) in such a way that a spacing between the suction conduit (18) and the pressure conduit (19) can be varied, wherein the spring (14) includes two curved legs (15, 16), wherein the two curved legs are joined together on one end and coupled to the sealing plate (13), and on another end, the two curved legs are coupled to the pump housing (1).

4. The internal gear pump of claim 3, wherein on a side of the sealing plate (3) remote from the ring gear (5) and the pinion (3), a pin (28) is guided axially displaceably at a certain spacing, wherein said pin cooperates with a further spring (29) in order to counteract a motion of the sealing plate (13) in the axial direction.

5. The internal gear pump of claim 4, wherein the fuel inlet (36) discharges into a sleeve, wherein the further spring (29) is received into the sleeve, and wherein radial bores (31, 32) are mounted in the sleeve for the passage therethrough of fuel.

6. The internal gear pump of claim 3, wherein the suction conduit (18) communicates with a fuel inlet (36), wherein a longitudinal axis of the fuel inlet coincides with a longitudinal axis of the drive shaft (2).

7. The internal gear pump of claim 3, wherein a bypass valve (22) is accommodated in the pump housing and communicates with the suction conduit (18) via a first axial bore (21) and with the pressure conduit (19) via a second axial bore (20).

* * * * *